US007323218B2

(12) United States Patent
Chen et al.

(10) Patent No.: US 7,323,218 B2
(45) Date of Patent: Jan. 29, 2008

(54) SYNTHESIS OF COMPOSITE NANOFIBERS FOR APPLICATIONS IN LITHIUM BATTERIES

(75) Inventors: Jin-Ming Chen, Taoyuan (TW); Chien-Te Hsieh, Taichung (TW); Hsiu-Wen Huang, Hsinchu (TW); Yue-Hao Huang, Kaohsiung (TW); Hung-Hsiao Lin, Miaoli (TW); Mao-Huang Liu, Taipei (TW); Shih-Chieh Liao, Chungli (TW); Han-Chang Shih, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 387 days.

(21) Appl. No.: 10/419,167

(22) Filed: Apr. 21, 2003

(65) Prior Publication Data

US 2004/0126305 A1 Jul. 1, 2004

(30) Foreign Application Priority Data

Dec. 30, 2002 (TW) ..... 91137905 A

(51) Int. Cl.
*B05D 7/22* (2006.01)
*H05H 1/24* (2006.01)
*C23C 16/00* (2006.01)

(52) U.S. Cl. ..... 427/181; 427/230; 427/569; 427/255.7; 427/282; 427/437; 427/443.1; 977/890; 977/891; 977/892; 977/893

(58) Field of Classification Search ..... 427/181, 427/206, 230, 237, 571, 574, 575, 576, 578, 427/248.1, 255.15, 255.7, 282, 430.1, 437, 427/443.1; 977/890–893; 205/131, 135, 205/161
See application file for complete search history.

(56) References Cited

U.S. PATENT DOCUMENTS 6,129,901 A * 10/2000 Moskovits et al. ..... 423/447.3
6,278,231 B1 * 8/2001 Iwasaki et al. ..... 313/310
6,346,303 B1 * 2/2002 Shih et al. ..... 427/571
6,589,682 B1 * 7/2003 Fleckner et al. ..... 429/34
6,597,090 B1 * 7/2003 Mancevski ..... 313/309
6,628,053 B1 * 9/2003 Den et al. ..... 313/310
6,919,009 B2 * 7/2005 Stonas et al. ..... 205/74
2001/0023986 A1 * 9/2001 Mancevski ..... 257/741
2001/0051367 A1 * 12/2001 Kiang ..... 435/182
2002/0055239 A1 * 5/2002 Tuominen et al. ..... 438/466

OTHER PUBLICATIONS

Pradhan et al., "Formation of Nickel Nanowires in the Cavity of Carbon Nanotubes", 1999.*

Li et al., "Highly-ordered carbon nanotube arrays for electronics applications", Applied Physics Letters, vol. 75, No. 3, Jul. 19, 1999, pp. 367-369.*

Meng et al., "Synthesis of A B-SiC Nanorod within a SiO2 Nanorod One Dimensional Composite Nanostructures", Solid State Communications, vol. 106, No. 4, 1998, pp. 215-219.*

* cited by examiner

*Primary Examiner*—William Phillip Fletcher, III
(74) *Attorney, Agent, or Firm*—Birch, Stewart, Kolasch & Birch, LLP

(57) ABSTRACT

Methods of fabricating one-dimensional composite nanofiber on a template membrane with porous array by chemical or physical process are disclosed. The whole procedures are established under a base concept of "secondary template". First of all, tubular first nanofibers are grown up in the pores of the template membrane. Next, by using the hollow first nanofibers as the secondary templates, second nanofibers are produced therein. Finally, the template membrane is removed to obtain composite nanofibers. Showing superior performance in weight energy density, current discharge efficiency and irreversible capacity, the composite nanofibers are applied to extensive scopes like thin-film battery, hydrogen storage, molecular sieving, biosensor and catalyst support in addition to applications in lithium batteries.

14 Claims, 8 Drawing Sheets

(a)

(b)

(c)

(a)

(b)

(c)

SYNTHESIS OF COMPOSITE NANOFIBERS FOR APPLICATIONS IN LITHIUM BATTERIES

BACKGROUND OF THE INVENTION

This nonprovisional application claims priority under 35 U.S.C. § 119(a) on Patent Application No(s). 091137905 filed in TAIWAN, R.O.C. on Dec. 30, 2002, which is(are) herein incorporated by reference.

1. Field of the Invention

The invention generally relates to a synthesis method of composite nanofibers, and particularly relates to a method for synthesizing composite nanofibers by forming a second nanofiber inside a first hollow nanofiber that plays as a secondary template.

2. Related Art

Recently, nanotechnology is extremely hot in industries. Many breakthroughs are obtained and undoubtedly cause great impacts to the industry. Among numerous nano-scale materials, nanofibers have excellent characteristics in their energy and photoelectric properties so as to be highly noticed.

A general method for producing nanofibers is the vapor deposition for fabricating vapor-growth carbon fibers. A carbon fiber is a hollow tubular structure having a diameter of 5~20 nanometers and having an outer surface on which a porous high surface area layer is formed. The porous surface makes the nanofiber an excellent adsorbent and catalyst support. However, the fabrication process is costly and energy intensive that limits the production and applications.

In view of this limitation, cost-oriented manufacturing process is an important point of nanofiber fabrication. For example, template synthesis is a method for producing high quality and lower cost nanofibers and taking the place of the expensive vapor deposition.

Different template synthesis methods have been developed for nanofiber fabrication. For example, sol-gel for $SiO_2$, $SnO_2$, $V_2O_5$, etc; electroless plating for Nickel; electro-deposition for ZnO, and so on. Specific template synthesis methods are applied in accordance with the materials and applications. However, a single material nanofiber usually cannot meet the application requirements. For example, in the application of lithium-ion secondary batteries, the Martin research group found that $SnO_2$ nanofibers for negative pole material of a lithium cell, though having a high reversible electric capacity larger than 700 mAh/g and high current discharge rate of 58 C, has a high irreversible electric capacity that limits the applications. The irreversible electric capacity is caused by a solid-electrolyte interphase of $Li_2O$ formed from deoxidation of $SnO_2$ and lithium-ions. The high irreversible electric capacity increases the surface impedance and decrease the lifetime of the nanofibers. The reaction mechanism is shown in FIG. 5. The reactions are as follows:

$$4Li^{+}+4e^{-}+SnO_2 \rightarrow 2Li_2O+Sn \quad \text{(equation I)}$$

$$xLi^{+}+xe^{-}+Sn \leftrightarrow Li_xSn,\ 0 \leq x \leq 4.4 \quad \text{(equation II)}$$

Wherein equation I shows the formation of $Li_2O$; equation II shows the reversible reaction of Li—Sn alloy, which provides the reversible electric capacity.

Therefore, as shown in FIG. 6, if a suitable material, such as a carbon coating, is applied on surface of a single material nanofiber, such as tin oxide $SnO_2$, for inhibiting the formation of solid-electrolyte interphase and decreasing the irreversible electric capacity, then the applicability of nanofibers can be improved.

The concept of synthesizing composite nanofibers for overcoming the problem of irreversible electric capacity in lithium battery application is thus generated. However, though the fabrication of single material nanofiber is easier, when forming a second material coating on exterior of the first nanofiber through conventional chemical vapor deposition or chemical impregnation, the coating is uneven in thickness and hard to be obtained. Therefore, bi-material nanofiber with even composition is a great difficulty of fabrication with conventional processes.

SUMMARY OF THE INVENTION

The object of the invention is to provide a method for synthesizing bi-material nanofibers. The invention overcomes the difficulties of precise controls to the construction, tube dimensions and chemical composition of the bi-material nanofibers.

The invention provides a method for fabricating composite nanofibers under a base concept of "secondary template". A precursor of carbon, metal or metal oxide is first embedded on a template membrane with pores of 50~800 nm diameters and 6~50 micron thickness, so that first tubular nanofibers are grown up in the pores of the template membrane through controls of process parameters. Next, by using the hollow first nanofibers as a secondary template, second nanofibers are produced in the inner surfaces of the first nanofibers. Finally, the template membrane is removed to obtain the composite nanofibers. The aspect ratio of the composite nanofiber can be controlled within 10 to 1000, and the inner and outer diameters can be within 10 to 700 nm and 50 to 800 nm respectively.

The method of "secondary template" of the invention is capable of producing high quality composite nanofibers and providing precise controls to the constructions, dimensions and chemical compositions of the nanofibers. The process reduces the cost, and provides nanofibers of small size, high weight energy density and high recharge and discharge efficiencies that meet the requirements of minimization of future products. The composite nanofibers can be applied to extensive scopes of micro electromechanical devices, micro integrated circuits and biochips, etc.

BRIEF DESCRIPTION OF THE DRAWINGS

The invention will become more fully understood from the detailed description given hereinbelow. However, this description is for purposes of illustration only, and thus is not limitative of the invention, wherein:

FIG. 7(*b*) is a SEM photo of a hollow epoxy-based carbon nanofiber produced through sol-gel process;

FIG. 7(*c*) is a SEM photo of a hollow silicon dioxide carbon nanofiber produced through sol-gel process;

FIG. 9(*b*) is a transmission electron microscopy (TEM) photo of a hollow carbon nanofiber before embedding the tin dioxide;

FIG. 9(*c*) is a TEM photo of a tin dioxide and carbon composite nanofiber after embedding the tin dioxide;

DETAILED DESCRIPTION OF THE INVENTION

Figure 1:
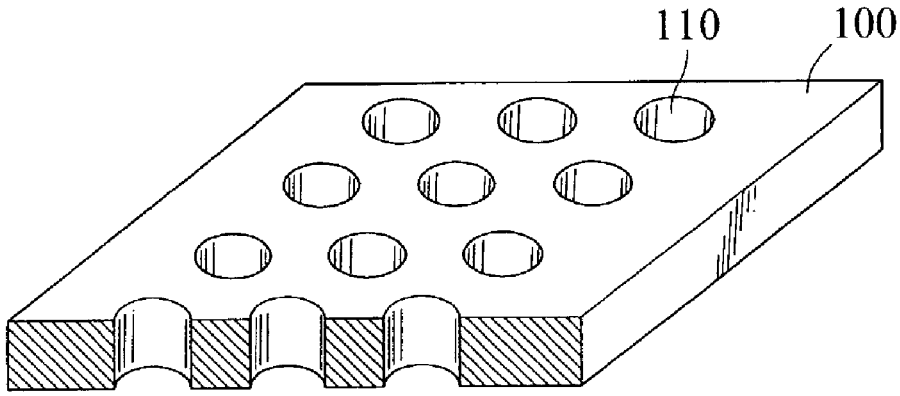
FIGS. 1 to 4 are explanatory views of fabrication processes for producing composite nanofibers of the invention.
Figure 2:
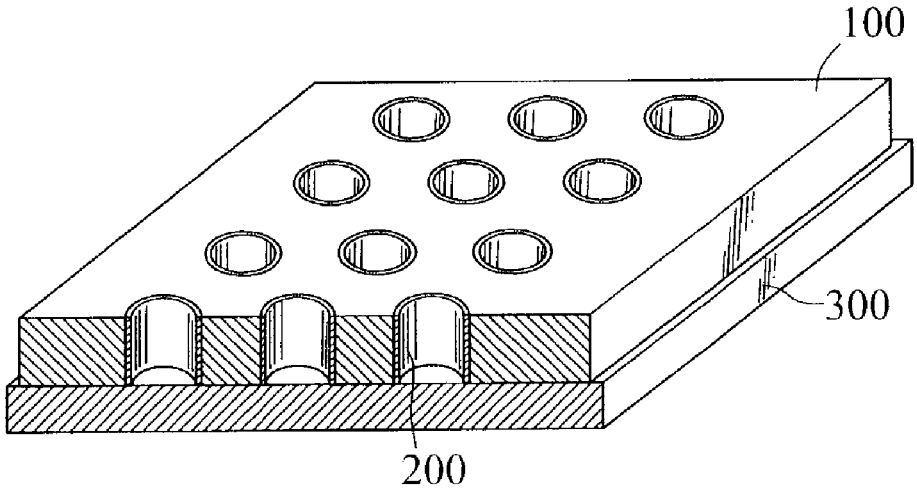
Figure 3:
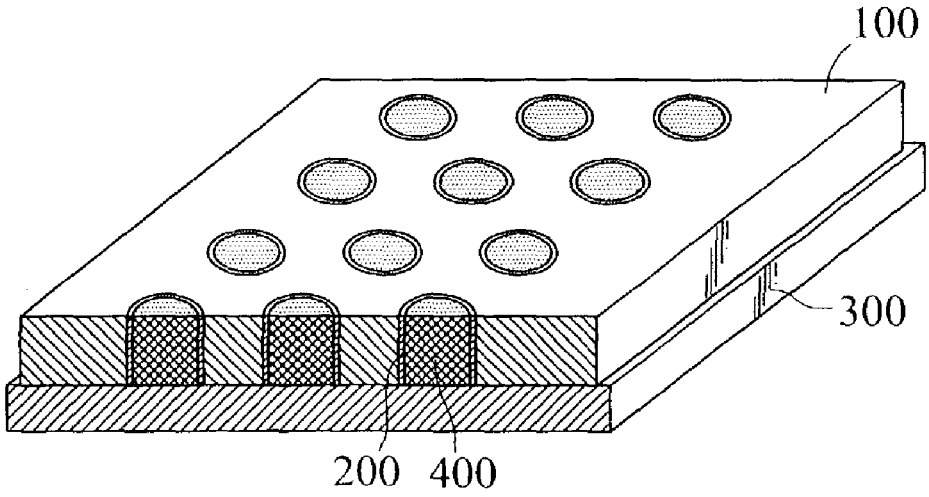
Figure 4:
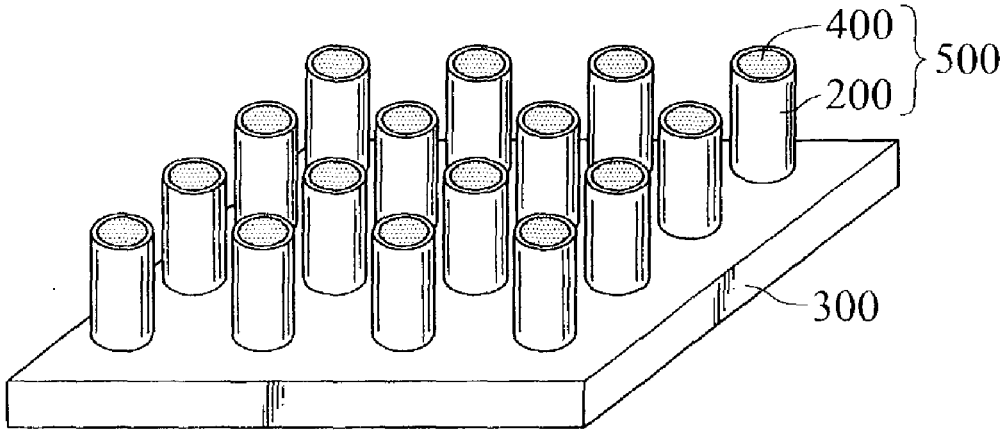
Figure 5:
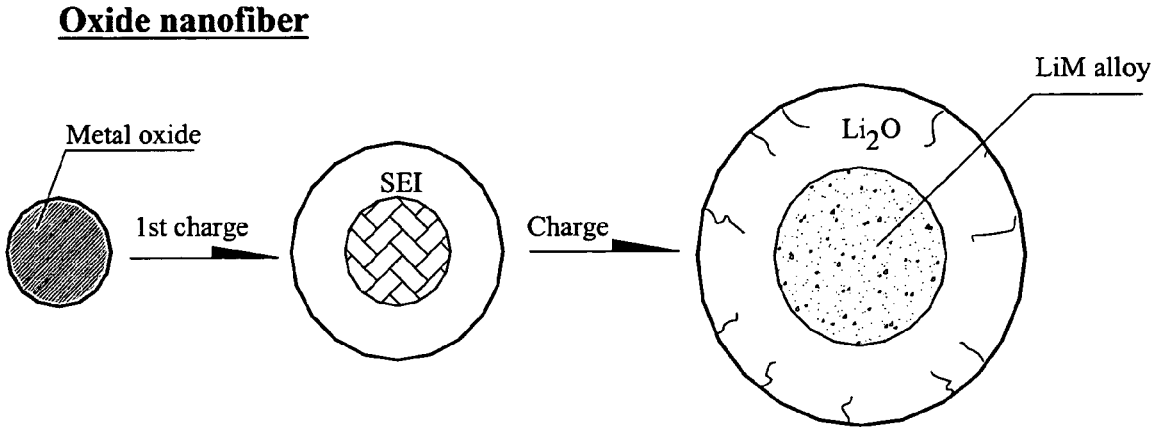
FIG. 5 (PRIOR ART)
FIG. 5 is a functional view of charge reaction of a metal oxide nanofiber applied to a lithium battery in prior art.
Figure 6:
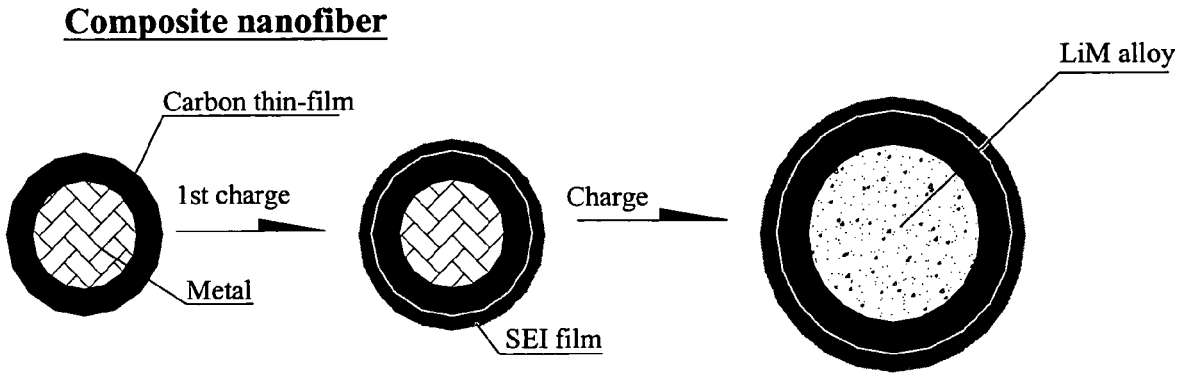
FIG. 6 (PRIOR ART)
FIG. 6 is a functional view of charge reaction of a composite nanofiber of the invention applied to a lithium battery in prior art.
Figure 7:
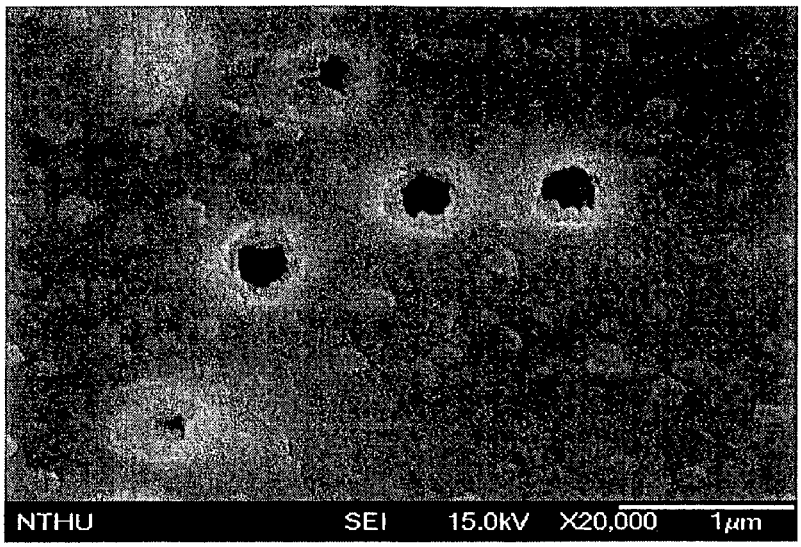
FIG. 7(*a*) is a scanning electron microscopy (SEM) photo of a hollow nanofiber generated through electron cyclotron resonance-chemical vapor deposition (ECR-CVD) process in a polycarbonate membrane having pore diameter of 400 nm, thickness of 6-10 microns and pore density of $10^7/cm^2$.
Figure 7:
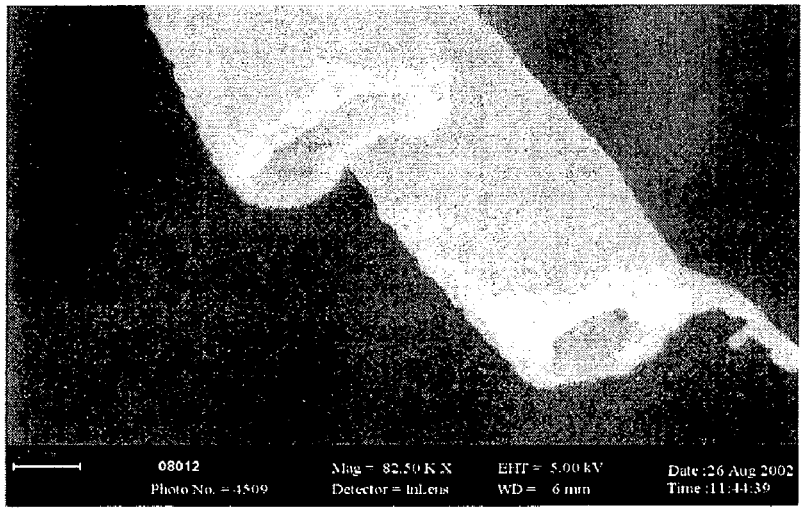
Figure 7:
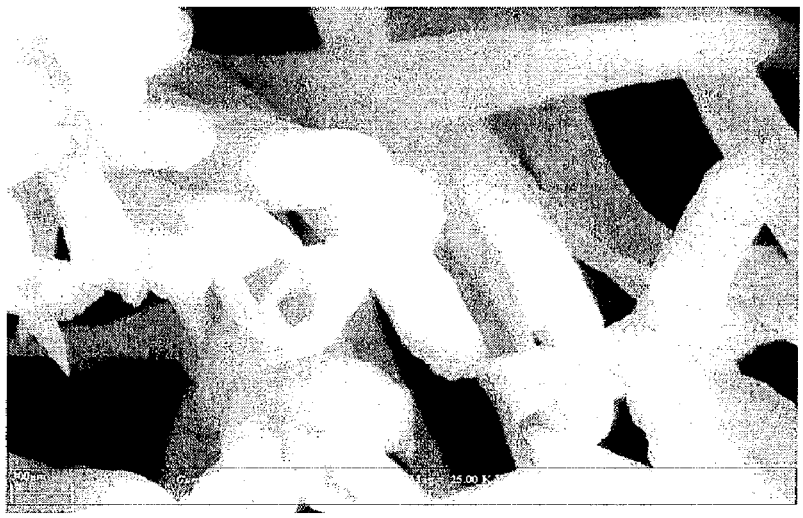
Figure 8:
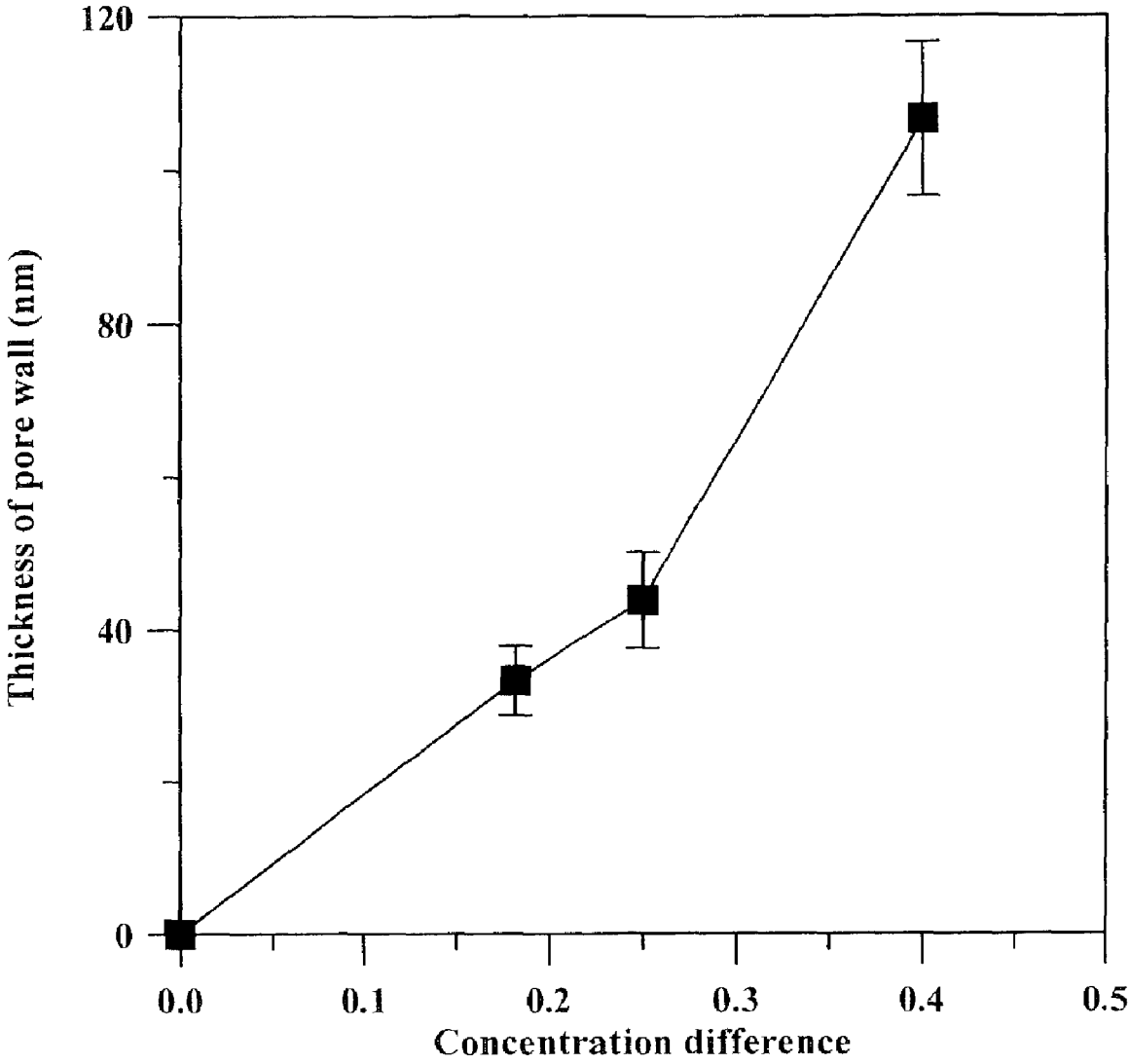
FIG. 8 is a thickness of pore wall to concentration curve diagram of a hollow epoxy-based carbon nanofiber produced through sol-gel process.

A process for fabricating composite nanofibers according to the invention is shown in FIGS. 1 to 4.

a) First, preparing a first tubular nanofiber. The first nanofiber is formed through a template 100 made of thin membrane of polycarbonate or anodic alumina and embedded with a first precursor (macromolecule, inorganic matter, metal oxide or carbon, etc) in the pores 110 of the template 100 through a method of sol-gel, chemical impregnation, electroless plating, electro-deposition or electron cyclotron resonance-chemical vapor deposition (ECR-CVD). The thickness of the hollow tubular nanofiber is controlled in accordance with the method and the parameters. For example, in sol-gel, the concentration, pH scale and soakage time are attended. In ECR-CVD, the vapor volume, deposition time and the kind of catalyst are attended. In electroless plating, the concentration, reaction time, pH scale and temperature are noticed. In electro-deposition, the voltage, current, time and pH scale are monitored. At last, a hollow tubular first carbon nanofiber 200 is obtained. Under suitable conditions, the pore wall thickness of the nanofiber is easy to be controlled. For example, FIG. 8 shows the relationship between pore wall thickness and concentration of epoxy-based hollow nanofibers made with sol-gel and with a same soakage time. The pore wall thickness is controllable through the concentration of the first precursor. The experiments show that the aspect ratio of the composite nanofiber can be controlled within 10 to 1000, and the inner and outer diameters can be controlled within 10 to 700 nm and 50 to 800 nm respectively.

b) Then, placing the template 100 on a current collector 300 and using the first carbon nanofiber 200 embeddded on the template as a secondary template for embedding a second precursor (macromolecule, inorganic matter, metal oxide or carbon, etc.) to obtain a second nanofiber 400. A current collector is a conductive material placed between the electrodes to secure the electric conduction therebetween and to reduce the internal resistance of the battery. The embedding methods include sol-gel, ECR-CVD, chemical impregnation, electro-deposition, electroless plating and so on. Some heat treatments may also be applied in accordance with the embedding method.

c) Finally, removing the template 100 with chemical etching or plasma etching in order to obtain composite nanofibers 500 composed of the first nanofibers 200 and the second nanofibers 400.

A detailed embodiment of the invention is further described hereinafter. The embodiment relates to fabrication of tin dioxide and carbon ($SnO_2$/C) composite nanofibers serving as negative pole materials of lithium batteries. The $SnO_2$/C composite nanofiber uses a polycarbonate membrane as a template and applies ECR-CVD or sol-gel process. The process is as follows.

a) Using palladium catalyst to prepare 1 M $PdCl_2$. Applying the 1 M $PdCl_2$ to the polycarbonate film. The film has pores with inner diameters of 100 to 800 nanometers and thickness of 6 to 10 microns;

b) Forming hollow carbon nanofibers by ECR-CVD. The wall thickness of the hollow carbon nanofiber is controlled through suitable voltage and operational time during using $C_2H_2$ as reaction gas, using inert gases (nitrogen, argon) as form-carrier under room temperature reaction and preventing deformation of the template;

c) Using the finished hollow carbon nanofiber as a secondary template and embedding $SnO_2$ precursor with sol-gel. The mole ratio of a Sn-based solution is $SnCl_2$:$C_2H_5OH$:$H_2O$:HCl=3:20:6:0.6. After a 24-hour sol-gel process, the prior template of polycarbonate membrane with carbon is soaked in the Sn-based solution for several hours, then taken out and placed on a clean stainless steel or nickel foil;

d) Placing the work piece in a furnace for heat treatment. With air atmosphere, increasing the air temperature up to 440 centigrade degrees at a rate of 10 degrees per minute. Maintaining the high temperature for one hour till the whole polycarbonate membrane being burned out and the $SnO_2$/C composite nanofibers being obtained.

Figure 9:
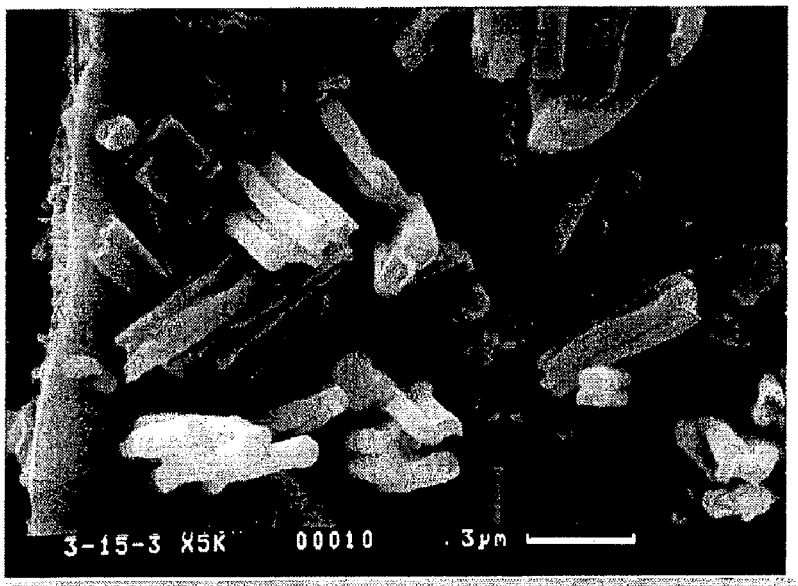
FIG. 9(*a*) is a SEM photo of a tin dioxide and carbon composite nanofiber.
Figure 9:
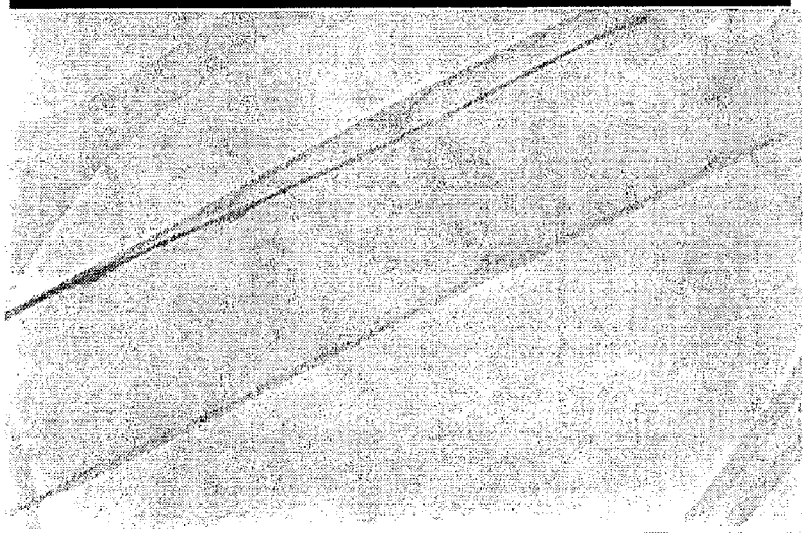
Figure 9:
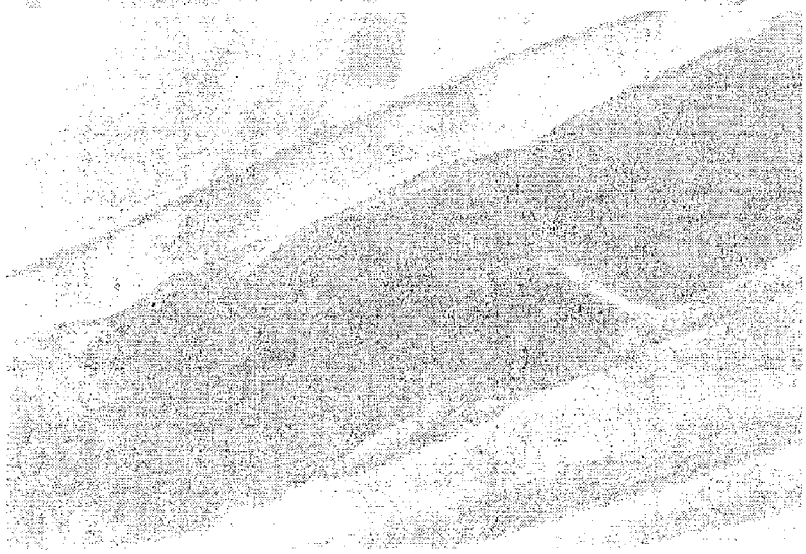

Some microscopy photos of $SnO_2$/C composite nanofibers fabricated with aforethe processes are shown in FIGS. 9(*a*) to 9(*c*). FIG. 9(*a*) is a scanning electron microscopy (SEM) photo of a $SnO_2$/C composite nanofiber; FIG. 9(*b*) is a transmission electron microscopy (TEM) photo of a hollow carbon nanofiber before embedding the tin dioxide; and FIG. 9(*c*) is a TEM photo of a $SnO_2$/C composite nanofiber after embedding the tin dioxide.

Figure 10:
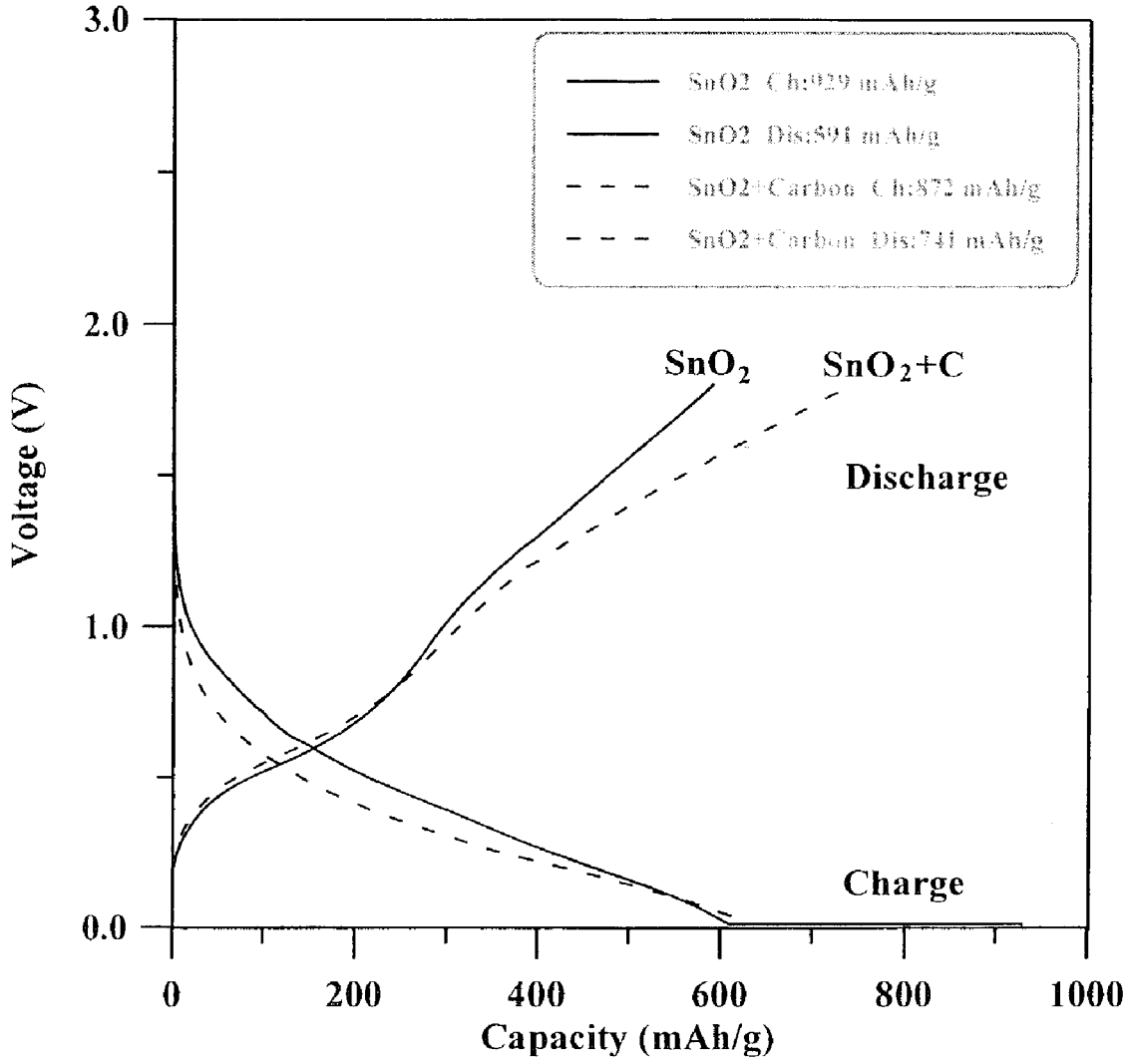
FIG. 10 is a diagram of 0.2 C charge/discharge curves of a tin dioxide nanofiber and a tin dioxide/carbon composite nanofiber.

When being applied as negative pole materials of a lithium-ion secondary battery, experimental test results of 0.2 C charge/discharge curves of $SnO_2$ and $SnO_2$/C composite nanofibers are shown in FIG. 10. It shows the $SnO_2$ nanofiber has irreversible capacity of 338 mAh/g and reversible capacity of 591 mAh/g; while the $SnO_2$/C nanofiber has irreversible capacity of 131 mAh/g and reversible capacity of 741 mAh/g. It proves that the composite nanofiber has a lower irreversible capacity (decreasing from 338 mAh/g to 131 mAh/g).

Figure 11:
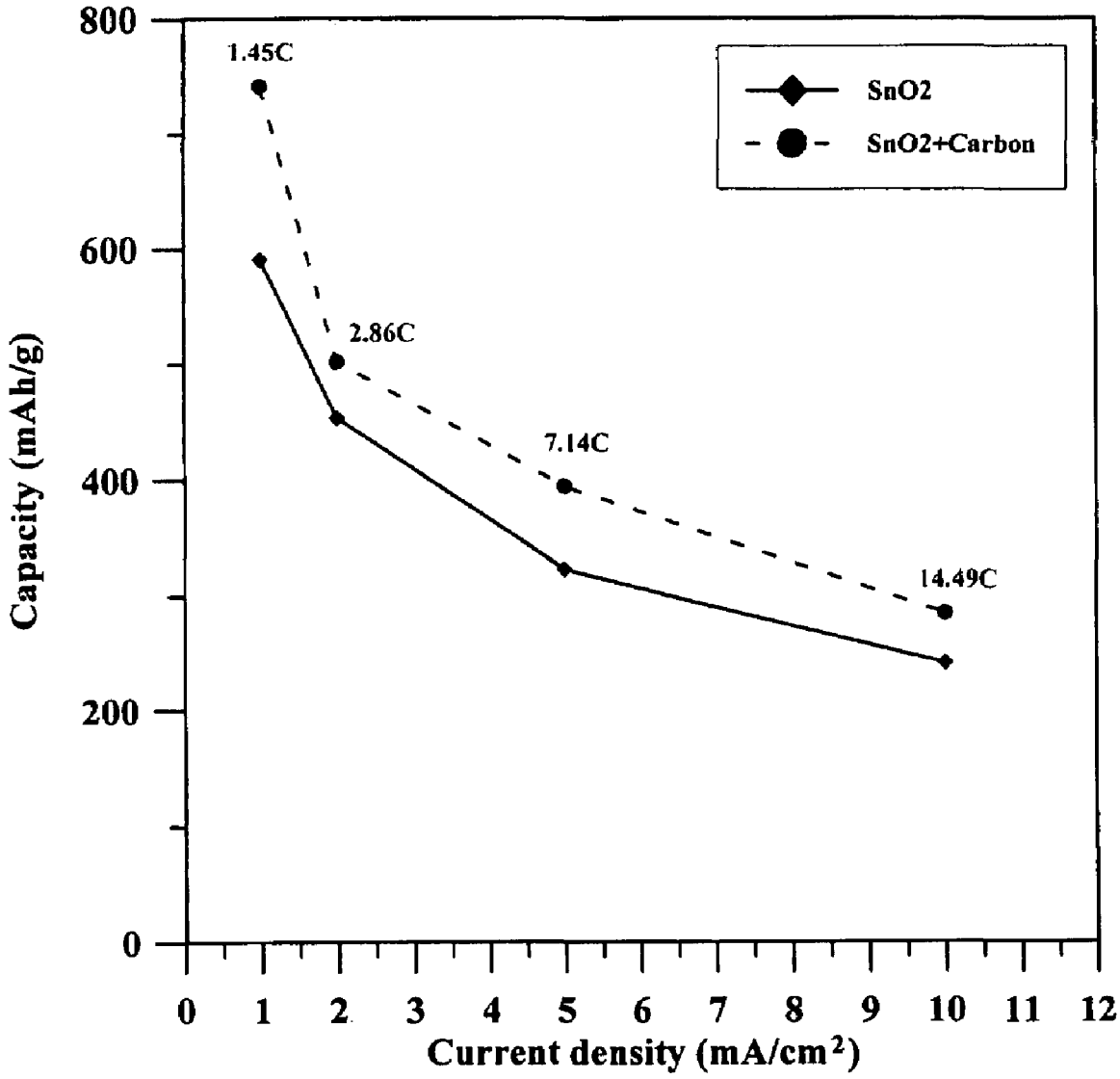
FIG. 11 is a diagram of electrochemical performance of a tin dioxide nanofiber and a tin dioxide/carbon composite nanofiber under different C-rates.

FIG. 11 is a diagram of electrochemical performance of a $SnO_2$ and a $SnO_2$/C composite nanofiber under different C-rates. It proves that the composite nanofiber has a higher current discharge rate.

In conclusion, the composite nanofibers, such as $SnO_2$/C, fabricated through process of the invention have advantages of higher weight energy density (740 mAh/g), lower irreversible capacity and higher current discharge rate (14.5 C). Moreover, the total thickness of the current collector (negative pole) and the nanofiber is only 20 to 35 microns that is a breakthrough for extremely thin lithium batteries and suitable for applications of power supplies for future micro-electromechanical products.

Though the above embodiment explains composite nanofiber applications for lithium-ion batteries, there is no limitation for other applications such as for thin-film batteries, hydrogen storage, molecular sieving, bio-sensors, catalyst supports and so on.

Also, according to experiments, the materials for the outer layer of a composite nanofiber can be chosen from silicon and carbon. The materials for the inner layer can be silicon, tin, nickel, copper; metal oxide $AO_x$ (A=Si, Sn, Sb, Co, Cu, Fe, Ni, Zn; $0<x<2$); tin alloys $SnM_y$ (M=Sb, Cu, Mg, Si; $0<y<2$) and others.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for fabricating composite nanofibers, comprising the steps of:

forming a plurality of tubular first nanofibers in a plurality of nano-scale pores of a template;

placing the template on a conductive current collector;

forming a plurality of second nanofibers on inner surfaces of the first nanofibers; and removing the template and obtaining a plurality of composite nanofibers.

2. The method for fabricating composite nanofibers according to claim 1 wherein the template is polycarbonate membrane or anodic alumina membrane.

3. The method for fabricating composite nanofibers according to claim 1 wherein the first nanofibers are formed through a process selected from the group consisting of sol-gel method, chemical impregnation, electroless plating, electro-deposition and electron cyclotron resonance-chemical vapor deposition.

4. The method for fabricating composite nanofibers according to claim 1 wherein the second nanofibers are formed through a process selected from the group consisting of sol-gel method, chemical impregnation, electroless plating, electro deposition and election cyclotron resonance-chemical vapor deposition.

5. The method for fabricating composite nanofibers according to claim 1 wherein the step of forming the first nanofibers further comprises a previous step of embedding a fast precursor in the template.

6. The method for fabricating composite nanofibers according to claim 5 wherein thickness of the first nanofiber is controlled by concentration of the first precursor.

7. The method for fabricating composite nanofibers according to claim 5 wherein the first precursor is selected from the group consisting of polymers, inorganic matters, metal oxide and carbon.

8. The method for fabricating composite nanofibers according to claim 1 wherein the step of forming the second nanofibers further comprises a previous step or embedding a second precursor in the template.

9. The method for fabricating composite nanofibers according to claim 8 wherein the second precursor is selected from the group consisting of polymers, inorganic matters, metal oxide and carbon.

10. The method for fabricating composite nanofibers according to claim 1 wherein material of the first nanofibers is silicon or carbon.

11. The method for fabricating composite nanofibers according to claim 1 wherein material of the second nanofibers is selected from the group consisting or Si, Sn, Ni, Cu, $AO_x$ and $SnM_y$, in which A=Si, Sn, Sb, Co, Cu, Fe, Ni, Zn; $0<x<2$; M=Sb, Cu, Mg, Si; $0<y<2$.

12. The method for fabricating composite nanofibers according to claim 1 wherein the template is removed through a process of chemical etching or plasma etching.

13. The method for fabricating composite nanofibers according to claim 1 wherein aspect ratios of the composite nanofiber are within 10 to 1000.

14. The method for fabricating composite nanofibers according to claim 1 wherein inner diameters of the composite nanofiber are within 10 to 700 nanometers, and outer diameters are within 50 to 800 nanometers.

* * * * *